US007017205B2

(12) United States Patent
Gladney

(10) Patent No.: US 7,017,205 B2
(45) Date of Patent: Mar. 28, 2006

(54) PLASTIC MATTRESS FOUNDATION

(75) Inventor: Richard F. Gladney, Fairburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/617,946

(22) Filed: Jul. 11, 2003

(65) Prior Publication Data

US 2004/0078897 A1 Apr. 29, 2004

Related U.S. Application Data

(60) Provisional application No. 60/395,449, filed on Jul. 11, 2002.

(51) Int. Cl.
*A47C 19/00* (2006.01)

(52) U.S. Cl. ..... 5/400; 5/201

(58) Field of Classification Search ..... 5/200.1, 5/201, 203, 400, 186.1, 285, 53.1
See application file for complete search history.

(56) References Cited

U.S. PATENT DOCUMENTS

| | | | | |
|---|---|---|---|---|
| 1,866,953 | A | 7/1932 | Stephens | |
| 2,075,319 | A | 3/1937 | Wilkie | |
| 2,508,506 | A | 5/1950 | Fridolph | |
| 2,687,537 | A | 8/1954 | Wallace et al. | |
| 2,827,952 | A * | 3/1958 | Propst | 267/103 |
| 2,908,918 | A | 10/1959 | Hopkes, Jr. | |
| 3,049,729 | A * | 8/1962 | Broyles | 5/200.1 |
| 3,083,380 | A * | 4/1963 | Adler | 5/727 |
| 3,546,725 | A | 12/1970 | Tambascio | |
| 3,585,356 | A | 6/1971 | Hall | |
| 3,754,289 | A | 8/1973 | Larkin | |
| 3,768,106 | A | 10/1973 | Fitzgerald | |
| 3,994,033 | A | 11/1976 | Bendell | 5/202 |
| 4,103,375 | A | 8/1978 | Santo | |
| 4,128,907 | A * | 12/1978 | Gelbart | 5/200.1 |
| 4,354,288 | A * | 10/1982 | Dennis | 5/400 |
| 4,476,595 | A | 10/1984 | Ikeda | |
| 4,583,254 | A | 4/1986 | Johenning | |
| 4,597,120 | A | 7/1986 | Fogel | |
| 4,602,396 | A | 7/1986 | Fraige | |
| 4,617,689 | A | 10/1986 | Nelson et al. | |
| 4,646,371 | A * | 3/1987 | Nowell | 5/200.1 |

(Continued)

FOREIGN PATENT DOCUMENTS

| | | |
|---|---|---|
| DE | 29517817 | 1/1996 |

(Continued)

*Primary Examiner*—Robert G. Santos
(74) *Attorney, Agent, or Firm*—Fish & Neave IP Group Ropes & Gray LLP

(57) ABSTRACT

A mattress assembly supporting a mattress and occupants is constructed substantially of plastic material. A mattress foundation defined by a semi-rigid cavity includes a generally flat top surface and at least one sidewall depending from the top surface. For pliability and structural weight reduction, the foundation may be ribbed, with air spaces formed therein. Ground support members may be used to retain the foundation in a substantially horizontal orientation above ground. To reinforce the foundation's structural integrity, support braces connecting opposing sidewall portions may be used. The braces may be detachable or integrally formed with the foundation. The assembly may include a headboard. To ease transport, casters may be included with the foundation. The assembly may be constructed of extruded or assembled plastic pieces; molded plastic; recyclable plastic; plastic reinforced with metal core, metal fiber, glass fiber, carbon fiber, resin or a combination of these.

38 Claims, 4 Drawing Sheets

U.S. PATENT DOCUMENTS

| | | | | |
|---|---|---|---|---|
| 4,662,015 | A | 5/1987 | Galumbeck | |
| 4,734,946 | A * | 4/1988 | Saputo | 5/400 |
| 4,759,088 | A | 7/1988 | Brown | |
| 4,774,733 | A | 10/1988 | Akers | |
| 4,870,711 | A | 10/1989 | Felix | |
| 4,878,259 | A | 11/1989 | Lupo | |
| 5,099,529 | A | 3/1992 | Anderson | |
| 5,136,740 | A | 8/1992 | Draft | 5/730 |
| 5,161,271 | A | 11/1992 | Gronbach | |
| 5,231,714 | A | 8/1993 | Mossbeck | 5/400 |
| 5,289,600 | A | 3/1994 | Schermel | |
| 5,469,589 | A | 11/1995 | Steed et al. | 5/400 |
| 5,564,960 | A | 10/1996 | Underhill | |
| 5,628,080 | A | 5/1997 | Quintile | |
| 5,701,653 | A | 12/1997 | Rupe | |
| 5,720,471 | A | 2/1998 | Constantinescu et al. | 267/81 |
| 5,858,508 | A | 1/1999 | Sturtevant | |
| 5,953,775 | A * | 9/1999 | Mauro et al. | 5/201 |
| 5,983,423 | A * | 11/1999 | Rupe | 5/236.1 |
| 6,108,834 | A | 8/2000 | Mauro | |
| 6,125,488 | A | 10/2000 | Vogland et al. | 5/739 |
| 6,292,960 | B1 | 9/2001 | Bowling | |
| 6,543,071 | B1 | 4/2003 | Lenner | |
| 6,557,191 | B1 * | 5/2003 | Bellows et al. | 5/200.1 |
| 6,615,425 | B1 | 9/2003 | Candell | |
| 6,658,677 | B1 | 12/2003 | Paul | |
| 6,785,920 | B1 | 9/2004 | Amador | |
| 6,832,397 | B1 | 12/2004 | Gaboury et al. | |
| 6,883,191 | B1 * | 4/2005 | Gaboury et al. | 5/201 |
| 2002/0069462 | A1 * | 6/2002 | Gaboury et al. | 5/201 |
| 2003/0024045 | A1 * | 2/2003 | Bellows et al. | 5/200.1 |
| 2003/0079284 | A1 * | 5/2003 | Gaboury et al. | 5/201 |
| 2003/0145377 | A1 | 8/2003 | Paul | |
| 2004/0078897 | A1 * | 4/2004 | Gladney | 5/400 |
| 2004/0128761 | A1 | 7/2004 | Gaboury | |
| 2005/0028274 | A1 * | 2/2005 | Hooper, Jr. | 5/400 |
| 2005/0028275 | A1 * | 2/2005 | Hooper, Jr. | 5/400 |
| 2005/0034233 | A1 * | 2/2005 | Gladney | 5/400 |
| 2005/0039259 | A1 * | 2/2005 | Gladney | 5/400 |
| 2005/0120478 | A1 * | 6/2005 | Hofmann | 5/400 |

FOREIGN PATENT DOCUMENTS

| | | |
|---|---|---|
| DE | 29618068 | 1/1997 |
| EP | 0954998 | 11/1999 |
| GB | 2 172 198 A | 9/1986 |
| WO | WO-01/05277 | 1/2001 |

* cited by examiner

PLASTIC MATTRESS FOUNDATION

CROSS-REFERENCE TO RELATED APPLICATIONS

This application claims the benefit of PPA Ser. No. 60/395,449.

BACKGROUND OF THE INVENTION

Today, foundations for mattresses are typically constructed of a combination of materials, including wood, metal, and fabric, and may include support subassemblies such as edge-reinforcing springs. The size and number of materials, typically selected for low cost, present numerous difficulties for consumers, including handling and disposal. In fact, many U.S. states have instituted disposal fees for mattress foundations, which can be as high as $100.00.

The use of plastic has emerged for certain subcomponents of mattress foundations. For example, plastic springs for a mattress foundation are disclosed in U.S. Pat. No. 5,720,471, and plastic interior corner guards are shown in U.S. Pat. No. 6,125,488. However, plastic has not been more widely used in mattress foundations. Hence, there remains a need for mattress foundations constructed exclusively or substantially of plastic.

SUMMARY OF THE INVENTION

The systems and methods described herein disclose a mattress foundation made entirely or substantially of plastic material. The foundation may be designed to fit into a standard bed frame. Ground support members, such as legs, may be added to the foundation to construct a mattress foundation and frame combination assembly.

The design principle is based, at least in part, on a combination of needs for a lighter-weight, more easily transportable, recyclable, and structurally robust mattress foundation or foundation-frame combination. In one embodiment, the foundation or foundation-frame combination assembly is designed to support a mattress of rectangular shape, such as a twin, full, queen, Olympic queen, or king mattress. In this embodiment, the foundation may be rectangular in shape and have four sidewalls.

The mattress foundation, or foundation-frame combination assembly, can withstand the combined load weight—that can be several hundred pounds—of a mattress and one or more occupants resting thereon. This is accomplished, at least in part, by the inclusion of a combination of supporting braces, reinforcing fins, and reinforcing trusses and/or other non-planar structures, disposed at structurally appropriate locations in, or along predetermined axes along, the foundation.

In an exemplary embodiment, the braces are designed to connect with, and structurally reinforce, the foundation in a snap-on, snap-off fashion; this can be accomplished, for example, by a tongue-and-groove, dovetail, or other functionally equivalent mating arrangements known in the art. To further increase the structural integrity of the foundation, the tongue and groove shapes are designed to prevent outward deflections of the foundation under load weights.

The mattress foundation comprises a cavity—made substantially or entirely of plastic material—defined by a generally planar top surface and one or more sidewalls depending downward from it. The foundation may be inserted into a standard bed frame, or, in an alternative embodiment, sustained above ground—in an approximately horizontal position—by ground support members connected with the foundation. The ground support members, which could be legs, may be removably coupled with the foundation or integrally formed with it. The foundation and the legs constitute a mattress foundation-frame combination assembly.

In one embodiment, the legs are attached to the foundation through a mating arrangement; the mating may involve a tongue-and-groove, dovetail, or other functionally equivalent configuration known in the art. The legs may have cross-sectional shapes designed based on, among other things, aesthetic and/or structural-mechanical considerations.

The use of a combination of braces, fins, trusses, and other, non-planar components for structural reinforcement is further justified when ground support members, or legs, retain the foundation in a substantially horizontal position above ground. In this embodiment, with the foundation resting on a set of legs—and not resting entirely on the ground along the lower edges of its one or more sidewalls—it becomes all the more important for the foundation's structural design to ensure that deflections and twists on the foundation, due to load weights, are sufficiently suppressed.

The overall shape of the mattress foundation is at least partly chosen to be compatible with the type of mattress that it is intended to support. For example, if the mattress is rectangular in shape, then the foundation may be reasonably designed to have a compatibly-sized rectangular top surface. In other embodiments, other shapes may be used; for example, a heart-shaped foundation may be designed for a similarly shaped mattress for use in, say, "honey-moon suites" in hotels. In other exemplary embodiments, circular, elliptical, or polygonal foundation shapes may be designed, consistent with the particular mattress type to be used, and in consonance with load weight considerations.

To lighten the weight of the plastic foundation, to increase its pliability for sleeping comfort, to improve its structural integrity under load weights, or for any combination of these, and other, reasons, the top surface and/or side walls of the foundation may optionally be ribbed, resulting in air spaces formed therein. Some portions of the top surface and/or the sidewalls may be designed to have one or more continuous, uninterrupted regions of plastic material, tying together opposing sidewall portions; this may be beneficial in terms of structural integrity, aesthetics, and a combination of these and/or other reasons.

In one embodiment, the sidewalls may be corrugated and/or have non-planar components, including, for example, trusses, that improve the structural integrity of the assembly.

The mattress foundation or foundation-frame combination assembly may optionally include a headboard that is attached or integrally formed with the foundation or the combination assembly. The lower part of the headboard may, in some embodiments, serve as a partial ground support to retain the foundation above ground.

To improve the mobility of the foundation, casters may be installed on, or integrally formed with, the foundation, for ease of rolling and transport. The casters may be disposed at select locations along the edges of, or on, one or more of the sidewalls, depending on the desired orientation of the foundation during transport. If a foundation is to be transported vertically, for example, then the casters may be connected with a sidewall, disposed perpendicularly to the surface of the sidewall.

In one embodiment, the foundation cavity may be designed to have mating shapes essentially along the periphery above the top surface and on the lower edges of the sidewalls, so that multiple foundations may be securely stacked—for example, one on top of another or, alternatively, vertically side by side—for easy shipment or retail store display; in this embodiment, the bottom of one foundation securely mates with the top of another foundation.

A person of ordinary skill in the art would know, or be able to readily ascertain, that there are various plastic compositions that may be used for the construction of the mattress foundation or of the combination foundation-frame assembly. For example, the foundation or the combination assembly may be made entirely of plastic. Alternatively, the foundation or the combination assembly may be made, at least in part, of plastic and non-plastic material: examples are plastic on metal; plastic reinforced with metal, carbon, or other fibers; plastic reinforced with resin; and any combination of these and other compositions known to those of ordinary skill in the art.

Furthermore, the plastic used in the construction of the mattress foundation, or of the foundation-frame assembly, may be molded plastic, made according to one or more of the plurality of methods known in the art, such as compression molding, injection molding, gas-assisted injection molding, vacuum molding, low-pressure molding, blow molding, and other molding methods. Those of ordinary skill in the art would know that various types of plastic may be used in the mattress foundation or in the foundation-frame combination assembly; examples include polyurethane, polyethylene, polystyrene, polyvinyl chloride, and polypropylene.

In a preferred embodiment, the plastic material is recyclable, so that if the owner of the mattress foundation or foundation-frame combination assembly wishes to dispose of the same, he or she would be able to do so without having to incur the fees that many municipalities charge for disposal of such items of furniture.

BRIEF DESCRIPTION OF THE FIGURES

The foregoing and other objects and advantages of the invention will be appreciated more fully from the following further description thereof, with reference to the accompanying drawings, wherein.

DETAILED DESCRIPTION OF THE ILLUSTRATED EMBODIMENTS

To provide an overall understanding of the invention, certain illustrative embodiments will now be described. These embodiments include, but are not limited to, mattress foundations formed entirely or substantially of molded plastic. However, it will be understood by one of ordinary skill in the art that the systems described herein can be adapted to other plastic foundations, such as foundations formed of extruded and assembled plastic pieces, or composite foundations of plastic over non-plastic structural members (e.g., metal) or reinforced plastic (e.g., with glass or carbon fibers, or fillers). All such modifications as would be clear to one of ordinary skill in the art are intended to fall within the scope of the systems described herein.

Figure 1:
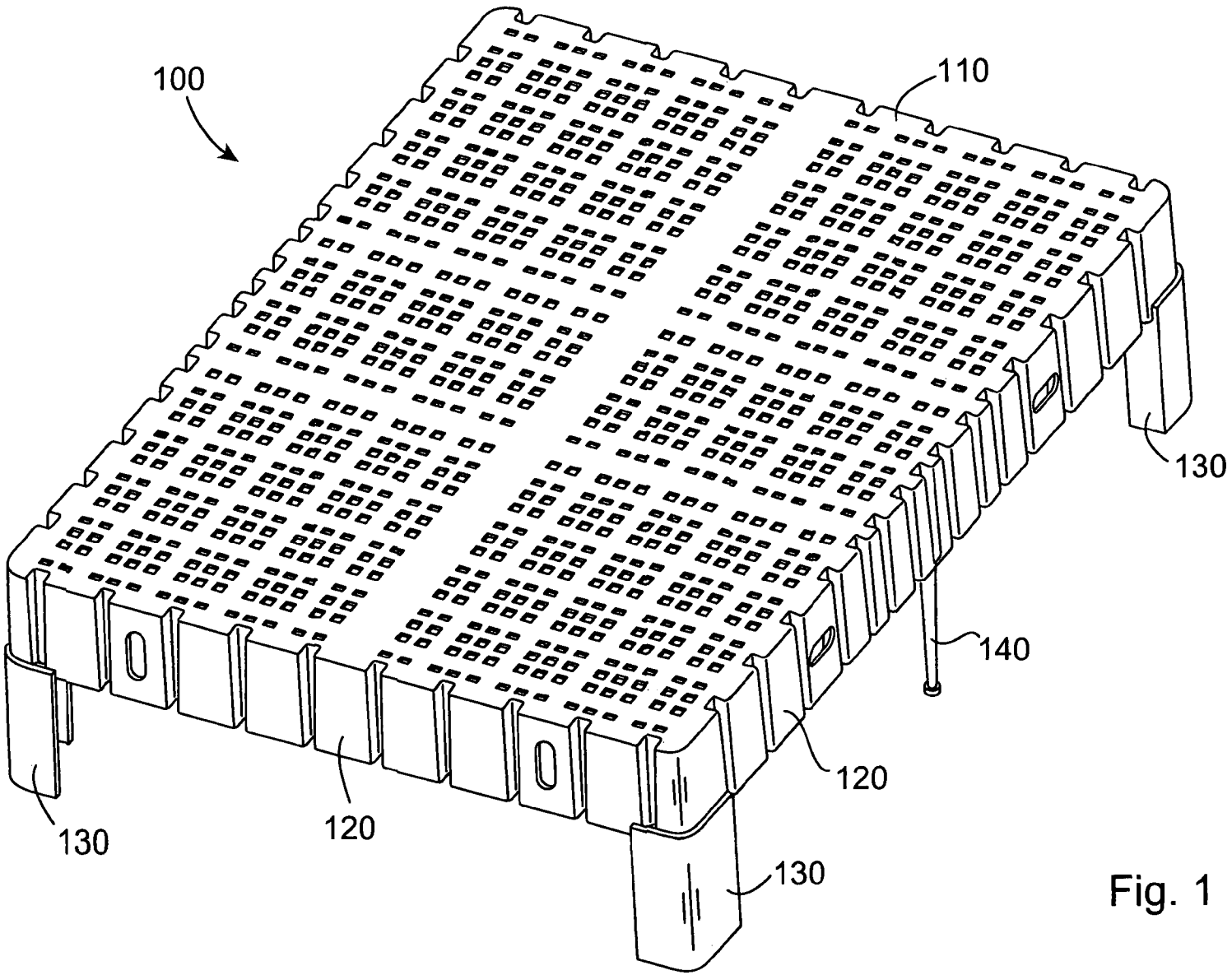
FIG. 1 is a top perspective view of a plastic mattress foundation and frame combination assembly.

FIG. 1 is a top perspective view of a plastic mattress foundation and frame combination assembly. The foundation 100 may include a top surface 110 and four sidewalls 120. Attached to, or integrally formed with, the foundation 100 may be four corner supports 130 and two supplemental supports 140. The foundation 100 may be used to support a mattress of any type, including a foam mattress, as well as mattresses of different constructions including pocketed coil construction, wire spring construction, water bed or any other suitable mattress construction. Moreover, it will be understood that although the depicted embodiment comprises a queen size mattress, mattresses of any size may be constructed according to the methods described herein.

The foundation 100 may be formed of any suitable plastic material, including, for example, polyurethane, polyethelene, polystyrene, polyvinyl chloride, polypropylene, or any other moldable plastic that can be formed with sufficient strength to support the weight born by a mattress foundation (including a mattress and one or more human occupants). The foundation may be formed using compression molding techniques such as injection molding, gas-assisted injection molding, vacuum molding, low-pressure molding, or blow molding, in which plastic in some elastic or fluid form is formed into the foundation 100 and permitted to set into a mechanically rigid structure.

The top surface 110 of the foundation 100 may be ribbed as shown in FIG. 1, so that air spaces are formed therein. This reduces weight in areas where less mechanical support is required, or where some pliability is desirable for sleeping comfort on a mattress atop the foundation 100. Certain regions, such as a central portion of the top surface 110, may, by contrast, be formed of an uninterrupted strip of plastic that ties together opposing sidewalls 120. The sidewalls 120 may be corrugated, or contain other non-planar shapes to increase structural rigidity of the sidewalls 120, and the overall foundation 100. Any other truss structure or other structurally enhancing configuration known in the mechanical arts may be used to improve the overall strength and rigidity of the foundation 100.

The corner supports 130 and supplemental supports 140, may be removably attached to the foundation 100 through any conventional mating arrangement, such as a tongue and groove, dovetail, or other functionally equivalent configurations known in the art. According to one embodiment, the corner supports 130 and the supplemental supports 140 may be integrally formed with the foundation 100. While two supplemental supports 140 are shown, it will be appreciated that any number of supports 140 may be used as required by the anticipated load on the mattress foundation 100 and the corresponding inherent strength of the top surface 110 and sidewalls 120. More particularly, the foundation 100 depicted in FIG. 1 is a foundation for a queen size mattress. It is expected that a king size mattress foundation may require additional supplemental supports 140, while a twin size mattress foundation may require no supplemental supports 140 whatsoever. Each supplemental support 140 and corner support 130 may have a cross-sectional shape to increase strength; examples are + shape, X shape, U shape, D shape, H shape, Z shape, C shape, V shape, M shape, B shape, T shape, circular shape, elliptical shape, L shape, heart shape, and any combination of these.

The overall structure of the foundation 100 may include mating shapes along an outside edge of the top surface 100 and along the bottom of the sidewalls 120, such that a plurality of foundations 100 may be conveniently stacked for shipping, storage, handling, or retail display. In addition to increasing the stability of a stack of foundations in, for example, a retail display, this technique may reduce the cost of shipping and eliminate the need for traditional wooden shipping pallets or other intermediate supports when transporting or storing the foundations 100.

Figure 2:
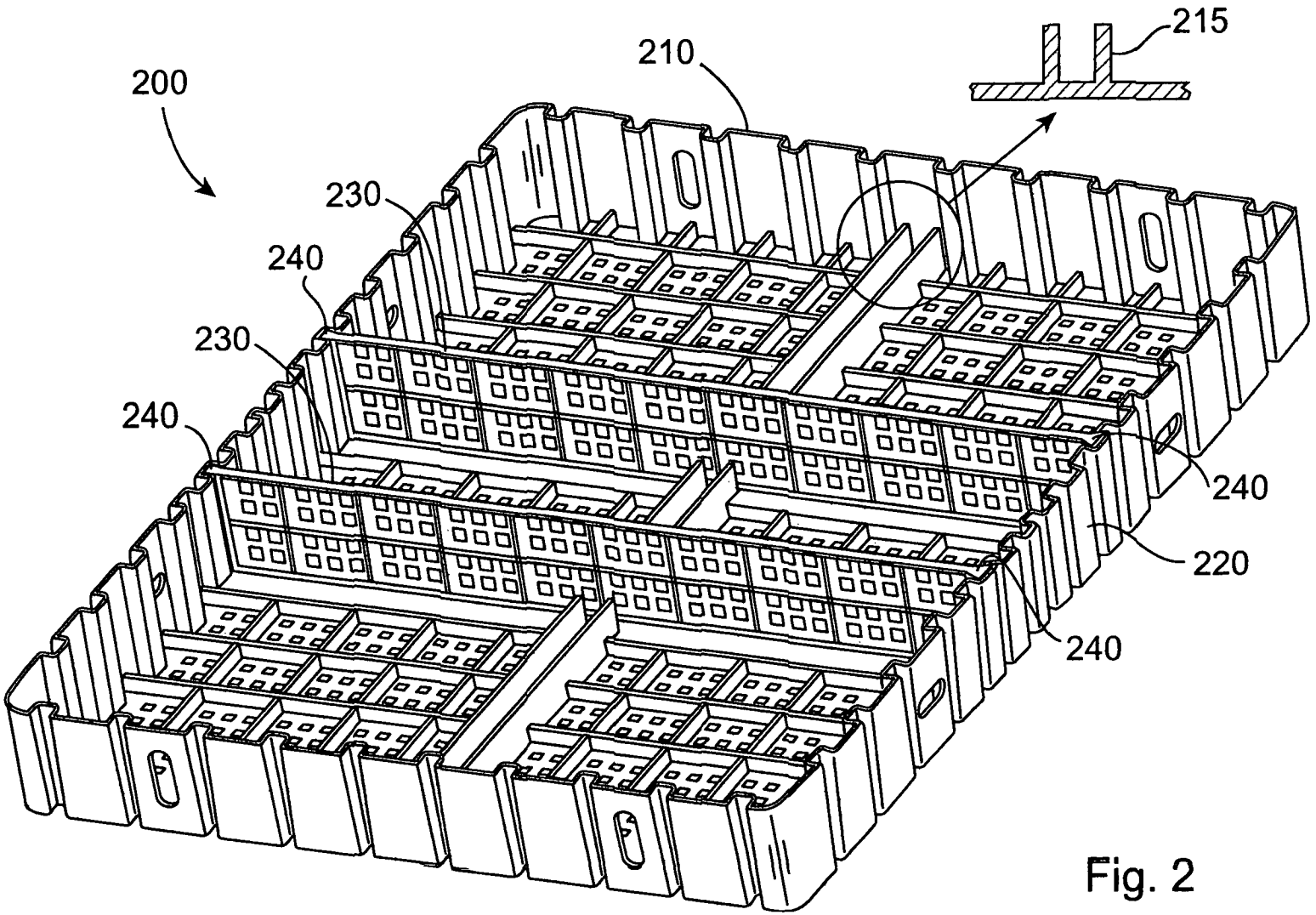
FIG. 2 is a bottom perspective view of a plastic mattress foundation.

FIG. 2 is a bottom perspective view of a plastic mattress foundation. As shown in FIG. 2, the foundation 200 may include a bottom surface 210 with a cross-sectional profile 215 and one or more sidewalls 220. One or more braces 230 may be connected to, or integrally formed with the foundation 200 such that opposing sidewalls 220 are interconnected to structurally support the foundation 200. The foundation 200 may generally be similar to the foundation 100 described above with reference to FIG. 1.

The sidewalls 220 may include one or more grooves 240 adapted to receive a corresponding tongue on each of the braces 230. The grooves 240 may be designed to allow for a snap-on, snap-off attachment of the braces to the foundation, thereby easing the assembly or disassembly of the foundation. Furthermore, the grooves 240 may be shaped to prevent undesirable outward deflection of the sidewalls under load weights. One example of such a shape is a trapezoid. Those of ordinary skill in the art would know of other shapes that can be used to accomplish the same purpose. Each brace 230 may include non-planar reinforcing structures and air spaces as described above generally with reference to the foundation 100 of FIG. 1.

The bottom surface 210 of the foundation 200 may include reinforcing structures to structurally reinforce the foundation 200, which must support a mattress and one or more occupants of the mattress. One structure for achieving this is perpendicular fins, as shown in the cross-sectional profile 215. Other reinforcing structures including trusses, additional braces, and so forth, may readily be used, provided their overall form is amenable to the selected manufacturing technique (most typically some form of compression molding).

The use of the support braces 230, fins (shown in the cross-sectional profile 215), trusses, and other non-planar reinforcing support structures is justified for more than one reason. Unlike a mattress foundation that sits directly on a flat surface, and the lower edges of whose sidewalls serve as mechanical supports that resist twisting, bending, and undesirable deflection, a mattress foundation that rests on a set of ground support members (such as corner supports 130 and/or supplementary supports 140) disposed at discrete points along the lower edge of the sidewalls 120, is subject to undesirable mechanical forces of twisting, bending, and deflection that require additional restraining structural reinforcement to suppress.

Additionally, any looseness in the structure, and resulting motion from load weights (in particular, shifting load weights) may cause squeaking sounds that are undesirable to the occupant or occupants of the mattress. To this end, the methods and systems described herein use, in a preferred embodiment, a combination of structurally reinforcing braces 230, fins (as shown in the cross-sectional profile 215), trusses, and other non-planar components to suppress undesirable deflections, bending, and twisting of the foundation under load weights.

Figure 3:
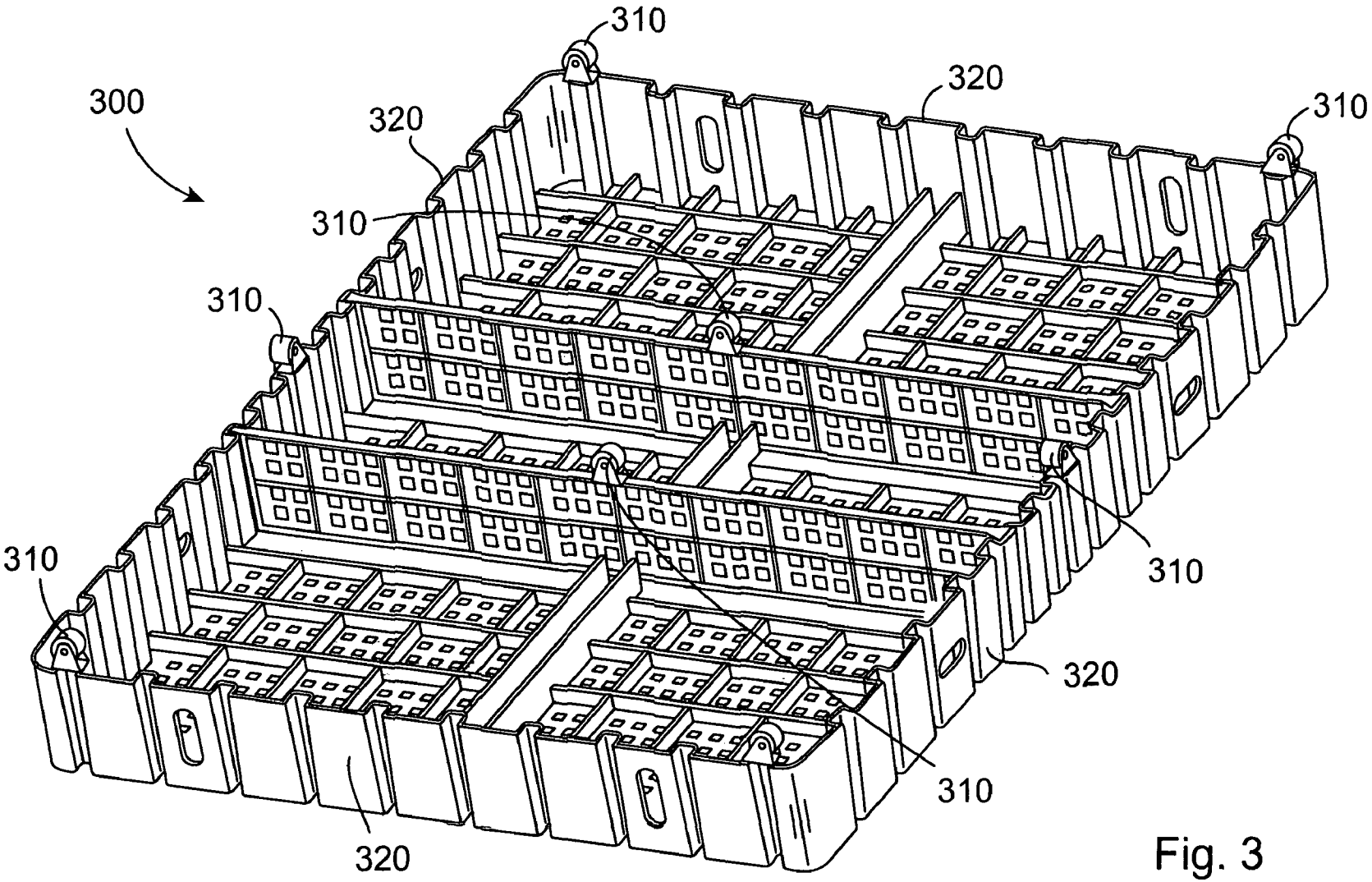
FIG. 3 is a bottom perspective view of a plastic mattress foundation including casters.

FIG. 3 is a bottom perspective view of a plastic mattress foundation. The foundation 300 depicted in FIG. 3 may be similar to any of the foundations described above in reference to FIGS. 1 and 2, as modified to include casters for easy rolling of the foundation 300, either with or without a mattress in place. The foundation 300 may include one or more slots or openings to receive casters 310, such as at the comers of the sidewalls 320. As depicted, one or more casters 310 may also attached to braces adjoining opposing sidewalls 320 in order to support regions of the foundation 300 inside the sidewalls 320, while continuing to permit rolling of the foundation 300 on the casters 310.

Figure 4:
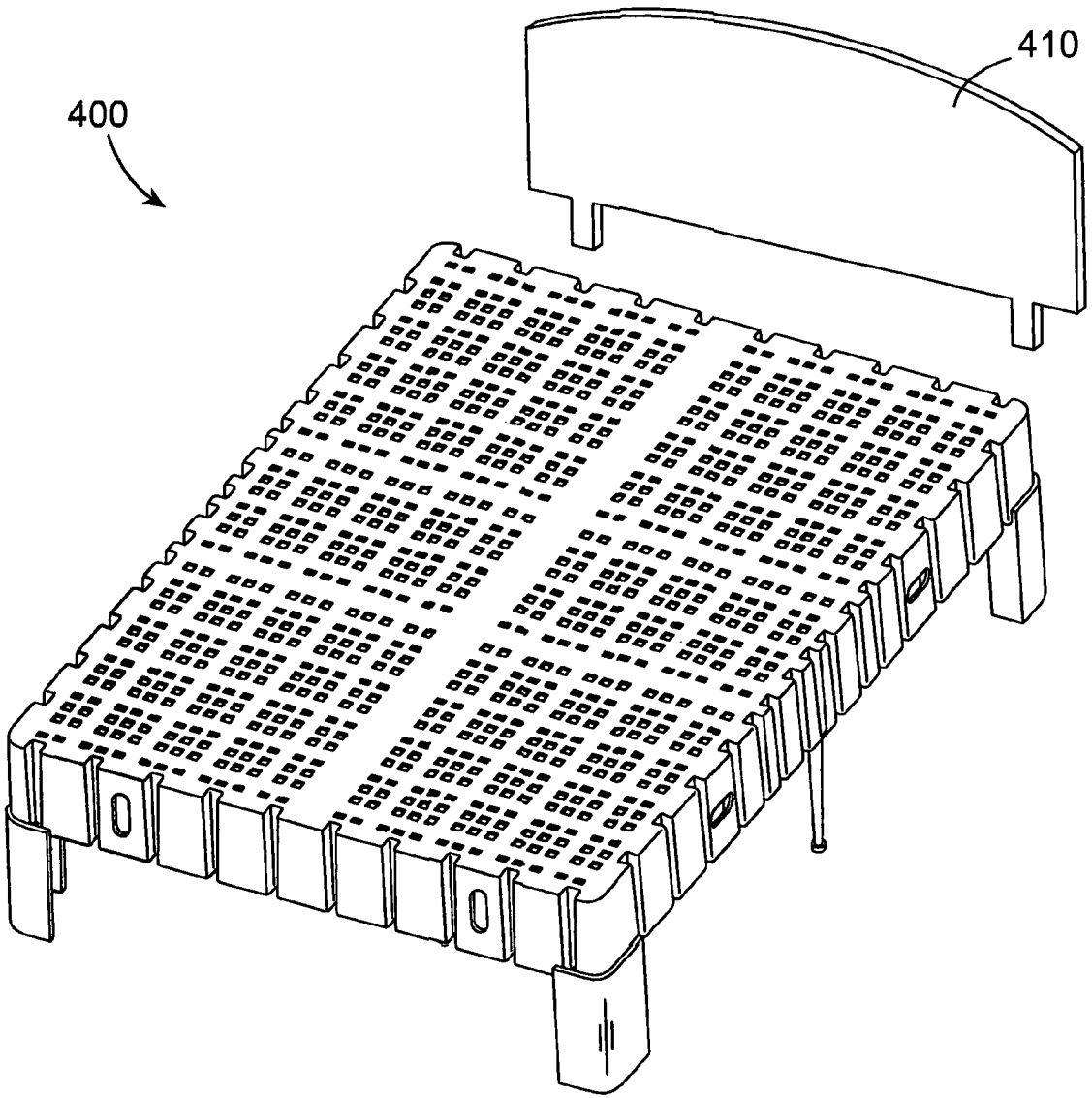
FIG. 4 depicts a plastic mattress foundation and frame combination, including a headboard.

FIG. 4 depicts a plastic mattress foundation-frame combination assembly including a headboard. The foundation 400 depicted in FIG. 4 may be similar to any of the foundations described above in reference to FIGS. 1–3, as modified to include a headboard. A headboard 410 may be removably attached to, or integrally formed with, the foundation 400, and may be formed of any of the plastic materials or composites described above.

In one aspect, there is described herein a recyclable mattress foundation. A foundation formed wholly or substantially from plastic may be readily recycled in a manner that permits recovery and reuse of plastic components. This may further present cost savings to a consumer who may be spared any applicable disposal fee for conventional mattress foundations.

In another aspect, there is disclosed herein a technique for manufacturing a mattress foundation that includes the steps of providing a foundation mold, inserting an elastic plastic into the mold so that the plastic takes the form of the mold, curing the plastic (or cooling the plastic, or taking other suitable steps to cause the plastic to harden), and removing the plastic foundation from the mold.

In another aspect, there is disclosed herein a mattress foundation formed of a single piece of a single material. The one-piece mattress foundation has ground supports and may optionally include a headboard and/or casters.

Those of ordinary skill in the art will know, or be able to ascertain using no more than routine experimentation, many equivalents to the embodiments and practices described herein. Accordingly, it will be understood that the invention is not to be limited to the embodiments disclosed herein, but is to be interpreted as broadly as allowed under the law, according to the following claims.

We claim:

1. A mattress assembly constructed substantially of plastic material, comprising:

a. a mattress foundation comprising:

i. a generally planar and essentially rigid top surface having an upper side and a lower side, the lower side of the top surface including at least one reinforcing fin, oriented perpendicularly to the lower side and extending along a portion of the lower side; and ii. at least one essentially rigid sidewall, having a lower edge and at least one pair of grooves disposed on opposing portions of the at least one sidewall, the sidewall extending substantially along the perimeter of the lower side of the top surface, depending downward from the top surface, defining a cavity;

b. a frame assembly comprising a plurality of ground support members supporting the foundation, depending downward from the lower edge of the at least one sidewall, holding the foundation above ground, and maintaining the top surface in a substantially horizontal orientation; and c. at least one brace connecting opposing portions of the at least one sidewall, said at least one brace having end sections configured to latchingly engage with the grooves so as to prevent outward deflection of the opposing portions of the at least one sidewall.

2. The assembly of claim 1, wherein each of the ground support members is removably or irremovably attached to the foundation.

3. The assembly of claim 1, wherein at least one of the ground support members is attached to the foundation by a mating configuration.

4. The assembly of claim 3, wherein the mating configuration is selected from the group consisting of: tongue-and-groove, dovetail, and any combination thereof.

5. The assembly of claim 1, wherein at least one of the ground support members is integrally formed with the foundation.

6. The assembly of claim 1, wherein each of the ground support members has a cross-sectional shape selected from the group consisting of: +shape, X shape, U shape, D shape, H shape, Z shape, C shape, V shape, M shape, B shape, T shape, circular shape, elliptical shape, L shape, heart shape, and any combination thereof.

7. The assembly of claim 1, wherein the perimeter of the top surface is polygonal.

8. The assembly of claim 7, wherein the polygon is selected from the group consisting of: a square and a rectangle.

9. The assembly of claim 8, wherein the foundation comprises four sidewalls.

10. The assembly of claim 9, wherein the foundation comprises four ground support members essentially located at four lower corners of the foundation.

11. The assembly of claim 1, wherein the perimeter of the top surface has a shape selected from the group consisting of: a circle, an ellipse, and a heart.

12. The assembly of claim 1, wherein the top surface is ribbed, having air spaces formed therein.

13. The assembly of claim 1, wherein the top surface has at least one region of continuous plastic spanning a substantially central portion of the top surface, tying together opposing portions of the at least one sidewall.

14. The assembly of claim 1, wherein the at least one sidewall is corrugated.

15. The assembly of claim 1, wherein the at least one sidewall comprises non-planar components that increase structural resistance to undesirable deflections from load weights.

16. The assembly of claim 1, further comprising at least one truss structure adjoining, and structurally reinforcing, opposing portions of the at least one sidewall.

17. The assembly of claim 1, wherein the upper side of the top surface further includes a first mating structure, and an edge region of the at least one sidewall further includes a second mating structure adapted to engage with the first mating structure, thereby allowing a plurality of mattress foundations to be securely stacked.

18. The assembly of claim 1, further including a headboard tangentially extending vertically along one end of the foundation.

19. The assembly of claim 18, wherein the headboard is removably attached to the foundation.

20. The assembly of claim 18, wherein the headboard is integrally formed with the foundation.

21. The assembly of claim 18, wherein the headboard is constructed substantially of plastic material.

22. The assembly of claim 1, wherein the foundation further includes a plurality of openings for receiving casters, the casters being used for easy rolling of the foundation.

23. The assembly of claim 22, wherein each of the plurality of casters is removably attached to the foundation by a latching configuration selected from the group consisting of: tongue-and-groove and dovetail.

24. The assembly of claim 1, wherein each of the at least one pair of grooves receiving one end of the at least one brace has a dovetail configuration.

25. The assembly of claim 1, wherein at least one of the at least one brace includes a non-planar reinforcing structure.

26. The assembly of claim 1, wherein at least one of the at least one brace is ribbed, having air spaces formed therein.

27. The assembly of claim 1, wherein the lower side of the top surface further comprises at least one reinforcing truss, oriented perpendicularly to the lower side and extending between opposing sides of the at least one sidewall.

28. The assembly of claim 1, wherein the plastic material comprises recyclable plastic.

29. The assembly of claim 1, wherein the plastic material comprises molded plastic.

30. The assembly of claim 29, wherein the molded plastic is constructed by a molding technique selected from the group consisting of: compression molding, injection molding, gas-assisted injection molding, vacuum molding, low-pressure molding, blow molding, and any combination thereof.

31. The assembly of claim 1, wherein the foundation comprises extruded and assembled plastic pieces.

32. The assembly of claim 1, wherein the foundation is constructed, at least in part, of at least one non-plastic structural member covered by plastic.

33. The assembly of claim 32, wherein the at least one non-plastic structural member is metal.

34. The assembly of claim 1, wherein the plastic material includes reinforced plastic.

35. The assembly of claim 34, wherein the reinforced plastic contains material selected from the group consisting of: glass fiber, carbon fiber, metal fiber, resin, and any combination thereof.

36. The assembly of claim 1, wherein the plastic material is selected from the group consisting of: polyurethane, polyethylene, polystyrene, polyvinyl chloride, polypropylene, a moldable plastic, and any combination thereof.

37. A mattress foundation constructed substantially of plastic material, comprising:

a. a generally planar and essentially rigid top surface having an upper side and a lower side, the top surface having at least one reinforcing fin, oriented perpendicularly to the lower side and extending along a portion of the lower side;

b. at least one essentially rigid sidewall extending substantially along the perimeter of the lower side of the top surface downward from the top surface and having at least one pair of grooves disposed on opposing portions of the at least one sidewall, defining a cavity; and c. at least one structurally reinforcing brace extending along the lower side of the top surface, connecting opposing portions of the at least one sidewall, said at least one brace having end sections configured to latchingly engage with the grooves so as to prevent outward deflection of the opposing portions of the at least one sidewall.

38. The foundation of claim 37, wherein each of the at least one pair of grooves receives one end of the at least one brace by a mating dovetail configuration.

* * * * *